US010370734B2

(12) United States Patent
Hatano et al.

(10) Patent No.: US 10,370,734 B2
(45) Date of Patent: Aug. 6, 2019

(54) METHOD FOR HEAT TREATMENT OF STAINLESS MEMBER, AND METHOD FOR PRODUCING FORGED STAINLESS PRODUCT

(71) Applicant: MITSUBISHI HITACHI POWER SYSTEMS, LTD., Kanagawa (JP)

(72) Inventors: Kohei Hatano, Tokyo (JP); Hiroharu Oyama, Tokyo (JP); Yasuo Matsunami, Tokyo (JP); Naoyuki Umezu, Tokyo (JP); Shuhei Kuroki, Tokyo (JP); Hidetaka Haraguchi, Tokyo (JP); Takumi Matsumura, Tokyo (JP); Motonari Machida, Tokyo (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 523 days.

(21) Appl. No.: 15/025,699

(22) PCT Filed: Sep. 29, 2014

(86) PCT No.: PCT/JP2014/075853
§ 371 (c)(1),
(2) Date: Mar. 29, 2016

(87) PCT Pub. No.: WO2015/053118
PCT Pub. Date: Apr. 16, 2015

(65) Prior Publication Data

US 2016/0237517 A1 Aug. 18, 2016

(30) Foreign Application Priority Data

Oct. 11, 2013 (JP) ..... 2013-213754

(51) Int. Cl.
*C21D 9/00* (2006.01)
*B21K 3/04* (2006.01)
(Continued)

(52) U.S. Cl.
CPC ..... *C21D 9/0068* (2013.01); *B21K 3/04* (2013.01); *C21D 1/18* (2013.01); *C21D 1/19* (2013.01);
(Continued)

(58) Field of Classification Search
CPC ... B21K 3/04; C21D 1/00; C21D 1/18; C21D 1/19; C21D 1/70; C21D 6/00;
(Continued)

(56) References Cited

U.S. PATENT DOCUMENTS

2003/0066580 A1* 4/2003 Miyata ..... C21D 8/105 148/593
2006/0157169 A1* 7/2006 Goldsteinas ..... C21D 1/613 148/633

FOREIGN PATENT DOCUMENTS

CN 101107368 1/2008
JP 57-198208 12/1982
(Continued)

OTHER PUBLICATIONS

International Search Report dated Dec. 16, 2014 in corresponding International Application No. PCT/JP2014/075853 (with English translation).
(Continued)

*Primary Examiner* — Matthew E. Hoban
*Assistant Examiner* — Anthony M Liang
(74) *Attorney, Agent, or Firm* — Wenderoth, Lind & Ponack, L.L.P.

(57) ABSTRACT

A heating step, in which a stainless member is heated to a temperature within or above a heating phase-transformation
(Continued)

temperature range (Ar) in which the stainless member is phase-transformed, is executed. A cooling step in which the stainless member heated in the heating step is cooled to a temperature below a cooling phase-transformation temperature range (Mr) in which the stainless member is phase-transformed, is executed. In the cooling step, cooling of the stainless member is suppressed in a control temperature range including the cooling phase-transformation temperature range (Mr).

8 Claims, 10 Drawing Sheets

(51) Int. Cl.

| | |
|---|---|
| ***C21D 6/00*** | (2006.01) |
| ***C21D 1/18*** | (2006.01) |
| ***C21D 1/70*** | (2006.01) |
| ***F01D 5/28*** | (2006.01) |
| ***C21D 6/02*** | (2006.01) |
| ***C21D 1/19*** | (2006.01) |
| ***C21D 8/00*** | (2006.01) |
| *C21D 1/00* | (2006.01) |

(52) U.S. Cl.
CPC ..... *C21D 1/70* (2013.01); *C21D 6/00* (2013.01); *C21D 6/002* (2013.01); *C21D 6/02* (2013.01); *C21D 8/005* (2013.01); *F01D 5/286* (2013.01); *C21D 1/00* (2013.01); *C21D 9/00* (2013.01); *F05D 2230/25* (2013.01)

(58) Field of Classification Search
CPC ..... C21D 6/002; C21D 6/02; C21D 8/005; C21D 9/00; C21D 9/0062; C21D 9/0068; F01D 5/286; F05D 2230/25
See application file for complete search history.

(56) References Cited

FOREIGN PATENT DOCUMENTS

| | | |
|---|---|---|
| JP | 11-182203 | 7/1999 |
| JP | 2000-129341 | 5/2000 |
| JP | 2002-249819 | 9/2002 |
| JP | 2005-194626 | 7/2005 |
| JP | 2007-146204 | 6/2007 |
| JP | 2008-527176 | 7/2008 |
| JP | 2012-140690 | 7/2012 |
| JP | 2013-508550 | 3/2013 |
| KR | 10-2007-0099648 | 10/2007 |

OTHER PUBLICATIONS

Written Opinion of the International Searching Authority dated Dec. 16, 2014 in corresponding International Application No. PCT/JP2014/075853 (with English translation).
First Office Action dated Dec. 30, 2016 in corresponding Chinese Application No. 201480053690.5 (with English translation).
Notice of Preliminary Rejection dated Feb. 13, 2017 in corresponding Korean Application No. 10-2016-7007800 (with English translation).

* cited by examiner

METHOD FOR HEAT TREATMENT OF STAINLESS MEMBER, AND METHOD FOR PRODUCING FORGED STAINLESS PRODUCT

TECHNICAL FIELD

The present invention relates to a method for heat treatment of a stainless member, and a method for producing a forged stainless product.

Priority of this application is claimed based on Japanese Patent Application No. 2013-213754, filed on Oct. 11, 2013 in Japan, the content of which is incorporated herein by reference.

BACKGROUND ART

After a stainless member is processed into a predetermined shape by forging or rolling, the forged stainless member or the like may be subjected to solutionizing heat treatment.

For example, PTL 1 discloses technology in which a stainless member forged at a high temperature of 1000° C. to 1300° C. is cooled, and then is subjected to heat treatment at a high temperature of 950° C. to 1125° C. again. In this technology, the heated stainless member is quenched at a cooling speed of 4° C./min to 5° C./min.

PTL 2 discloses technology other than the technology disclosed in PTL 1, which is related to the present invention. In this technology, after an aluminum alloy member is heated for heat treatment, the aluminum alloy member is quenched by blowing a cooling medium to the aluminum alloy member via multiple nozzles. In a case where a metal member is quenched, a high-temperature portion, the temperature of which is easily decreased, and a low-temperature portion, the temperature of which is not easily decreased, are formed in the metal member depending on the shape of the member. As a result, thermal stress and strain occur in the metal member during a cooling process of the metal member. In the technology disclosed in PTL 2, the flow rate of the cooling medium blowing via the multiple nozzles is adjusted to suppress the occurrence of strain in the quenching process of the aluminum alloy member.

CITATION LIST

Patent Literature

[PTL 1] Japanese Unexamined Patent Application, First Publication No. 2012-140690

[PTL 2] Japanese Unexamined Patent Application, First Publication No. 2007-146204

SUMMARY OF INVENTION

Technical Problem

The technology disclosed in PTL 2 refers to technology for an aluminum alloy member. A stainless member has properties different from those of an aluminum alloy member. For this reason, even if the stainless member is heated for heat treatment, and then is subjected to the technology disclosed in PTL 2, it becomes difficult to suppress the occurrence of strain in a cooling process.

An object of the present invention is to provide a method for heat treatment of a stainless member, which is capable of suppressing the occurrence of strain in a process of heating a stainless member for heat treatment and then cooling the stainless member, and to a method for producing a forged stainless product.

Solution to Problem

According to an aspect of the present invention, in order to achieve this object, there is provided a method for heat treatment of a stainless member, a heating step, in which a stainless member is heated to a temperature within or above a heating phase-transformation temperature range in which the stainless member is phase-transformed when the stainless member is heated, is executed, and a cooling step, in which the stainless member heated in the heating step is cooled to a temperature below a cooling phase-transformation temperature range in which the stainless member is phase-transformed when the stainless member is heated, is executed. In the cooling step, cooling of the stainless member is suppressed in a control temperature range including the cooling phase-transformation temperature range. The stainless member in this application is phase-transformed in the heating step and the cooling step.

In the cooling phase-transformation temperature range, the stainless member is likely to be deformed. In the heat treatment method, cooling of the stainless member is suppressed in a temperature range including the cooling phase-transformation temperature range. As a result, in the heat treatment method, it is possible to suppress temperature differences between portions of the stainless member in the cooling phase-transformation temperature range, and to decrease thermal stress occurring in the stainless member. Accordingly, in the heat treatment method, it is possible to decrease strain of the stainless member.

In the method for heat treatment of a stainless member according to the aspect, in the cooling step, a cooling medium may be supplied to the stainless member.

In a case where the cooling medium is supplied to the stainless member, the flow rate of the cooling medium supplied to the stainless member per unit time may be set to be smaller than those immediately before the temperature of the stainless member reaches the control temperature range and immediately after the temperature passes the control temperature range.

In a case where the cooling medium is supplied to the stainless member, in the cooling step, the length of time from when the cooling of the stainless member is started until when the temperature of the stainless member reaches the cooling phase-transformation temperature range may be obtained in advance. In the cooling step, the flow rate of the cooling medium supplied to the stainless member may be decreased before the length of time obtained in advance has elapsed from when the cooling of the stainless member is started.

In a case where the cooling medium is supplied to the stainless member, a phase-transformation start temperature of the cooling phase-transformation temperature range may be obtained in advance. In the cooling step, the flow rate of the cooling medium supplied to the stainless member may be decreased before the temperature of the stainless member reaches the phase-transformation start temperature.

In a case where the cooling medium is supplied to the stainless member, the flow rate of the cooling medium supplied to the stainless member may be gradually increased from when the cooling step is started until when a predetermined length of time has elapsed, or from when the cooling step is started until when the temperature of the stainless member reaches a predetermined temperature.

In a case where, after the stainless member is placed into a heating furnace, and is heated, the stainless member is extracted from the heating furnace, and is cooled, since an ambient temperature around the stainless member is basically room temperature in the cooling step, the ambient temperature around the stainless member is rapidly decreased from immediately before the end of the heating step to immediately after the start of the cooling step. Accordingly, in the heat treatment method, the flow rate of the cooling medium supplied to the stainless member is gradually increased from when the cooling step is started until when the predetermined length of time has elapsed, or from when the cooling step is started until when the temperature of the stainless member reaches the predetermined temperature. A change in the temperature of the stainless member is suppressed. As a result, in the heat treatment method, it is possible to suppress temperature differences between portions of the stainless member, and to decrease strain of the stainless member.

In the method for heat treatment of a stainless member, in the cooling step, a covering member covering a large surface area portion of the stainless member may be provided on a large surface area portion having a large surface area per unit mass.

In the stainless member, the large surface area portion having a large surface area per unit mass is easily cooled compared to a small surface area portion having a small surface area per unit mass, and the cooling speed of the large surface area portion is higher than that of the small surface area portion. In the heat treatment method, since the covering member covers the large surface area portion which is easily cooled, it is possible to suppress the cooling speed of the large surface area portion. For this reason, in the heat treatment method, it is possible to suppress cooling of the large surface area portion of the stainless member in a temperature range including the cooling phase-transformation temperature range. Accordingly, in the heat treatment method, it is possible to suppress a temperature difference between the large surface area portion and the small surface area portion, and to decrease strain of the stainless member.

In a case where the covering member is provided, the amount of heat dissipation per unit mass from the large surface area portion covered with the covering member may approximate to the amount of heat dissipation per unit mass from a portion not covered with the covering member.

In a case where the covering member is provided, the covering member may be made of the same material as that of the stainless member.

In the heat treatment method, since the thermal expansion coefficient of the stainless member is the same as that of the covering member, the cooling target and the covering member are capable of integrally contracting in a cooling process, and heat transfer between the stainless member and the covering member can be substantially constant. In addition, the stainless member and the covering member have the same thermal properties such as a heat transfer coefficient other than a thermal expansion coefficient. For this reason, in the heat treatment method, it is possible to easily determine various dimensions of the covering member, by which the amount of heat dissipation from the small surface area portion not covered with the covering member is adjusted to be substantially the same as the amount of heat dissipation from the large surface area portion covered with the covering member.

In a case where the covering member is provided, the covering member may be provided on the stainless member before the heating step is started.

In the heat treatment method, when the cooling step is started, it is possible to substantially eliminate a temperature difference between the stainless member and the covering member, and possible to suppress the occurrence of thermal strain based on the temperature difference when the covering member is attached to the stainless member.

In the method for heat treatment of a stainless member, the stainless member may be made of a precipitation hardening stainless steel.

In the method for producing a forged stainless product according to the aspect of the present invention, in order to achieve this object, after executing a forging step, in which a stainless member is processed into a predetermined shape by forging, any one of the methods for heat treatment of a stainless member is executed on the stainless member subjected to the forging step.

In this case, the forged stainless product may be a blade of a steam turbine.

Advantageous Effects of Invention

According to an aspect of the present invention, it is possible to suppress temperature differences between portions of a stainless member in a cooling phase-transformation temperature range, and to decrease thermal stress occurring in the stainless member. Accordingly, according to the aspect of the present invention, it is possible to decrease the strain of the stainless member.

DESCRIPTION OF EMBODIMENTS

Hereinafter, various embodiments and modification examples of the present invention will be described with reference to the accompanying drawings.

First Embodiment

First, a first embodiment of the present invention will be described with reference to FIGS. 1 to 7.

Figure 2:
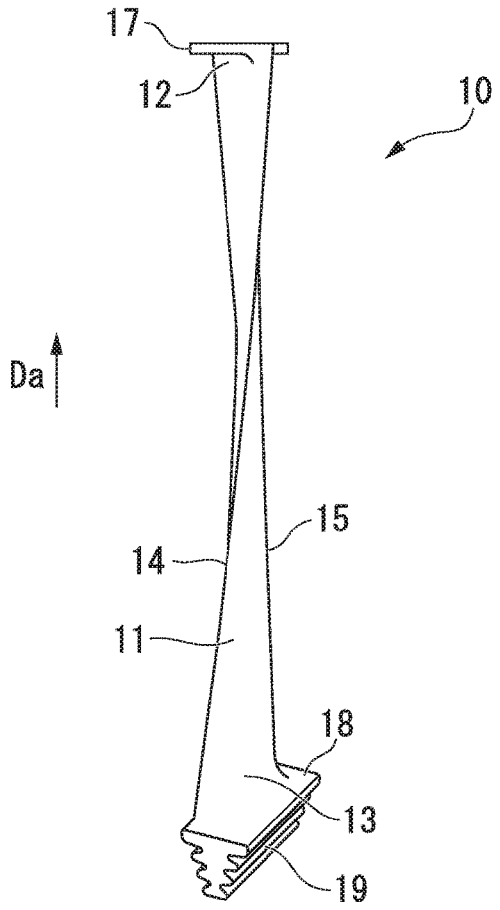
FIG. 2 is a perspective view of the rotor blade in the first embodiment of the present invention.

In this embodiment, a rotor blade of a steam turbine is produced. As illustrated in FIG. 2, a rotor blade 10 of a steam turbine includes a blade body 11; a shroud 17 provided in a tip portion 12 which is one end portion of the blade body 11; a platform 18 provided in a base portion 13 which is the other end portion of the blade body 11; and a blade root 19 provided on a second side of the platform 18. For example, the rotor blade is made of a precipitation hardening stainless steel.

Figure 3:
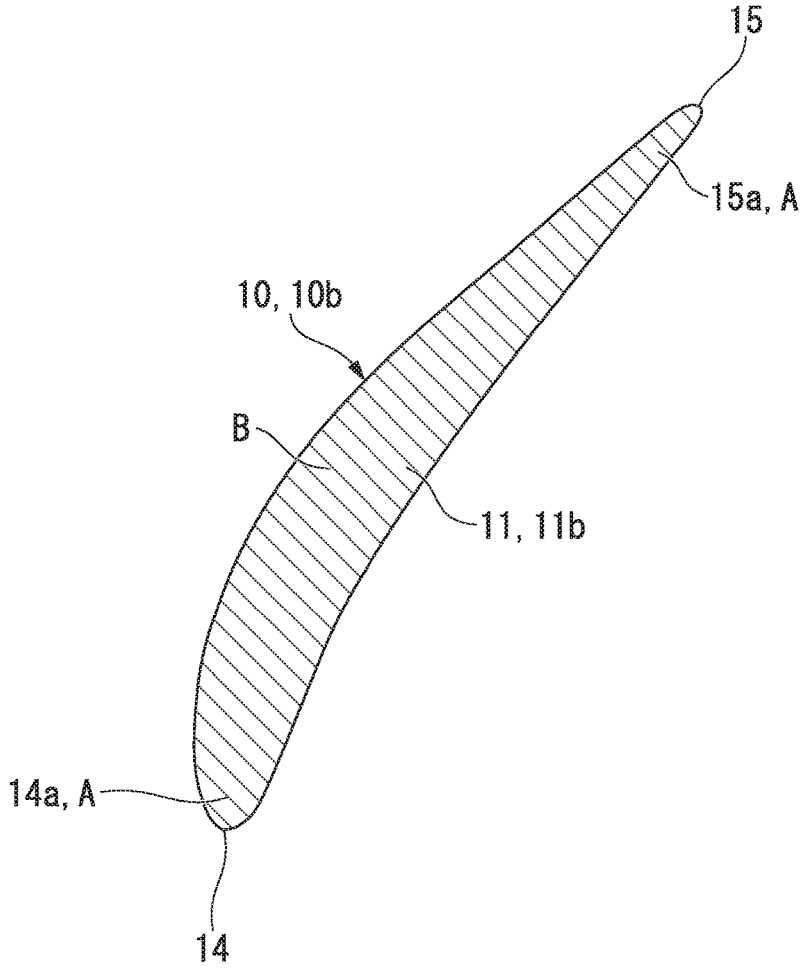
FIG. 3 is a sectional view of the rotor blade (stainless member) in the first embodiment of the present invention.

The blade root 19 is mounted on a rotor shaft of the steam turbine. For this reason, the blade root 19 is formed into a Christmas tree shape such that the rotor blade 10 is not disengaged from the rotor shaft during rotation of the rotor shaft. As illustrated in FIG. 3, the blade body 11 is formed into a spindle-like sectional shape perpendicular to a blade length direction Da from the base portion 13 toward the tip portion 12. More specifically, in the sectional shape of the blade body 11, the blade thickness dimension is gradually increased from a blade front edge 14 toward a blade rear edge 15, and is gradually decreased from a central portion between the blade rear edge 15 and the blade front edge 14 toward the blade rear edge 15.

Figure 1:
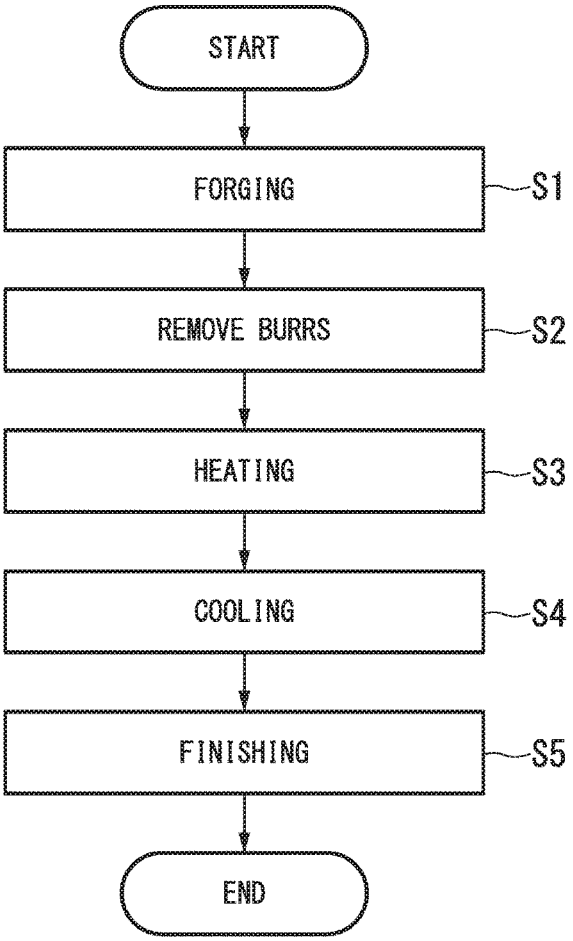
FIG. 1 is a flowchart illustrating the sequence of a method for producing a rotor blade in a first embodiment of the present invention.

Hereinafter, a method for producing the aforementioned rotor blade will be described with reference to the flowchart illustrated in FIG. 1.

First, stainless members made of a precipitation hardening stainless steel are heated to 1000° C. or greater, and are processed into substantially the same shape as the shape illustrated in FIG. 2 by forging (S1: forging step).

Subsequently, burrs formed on the outer circumferences of the stainless members are removed from the stainless members which have been subjected to the forging step (S1) and cooled to room temperature (S2: burr removing step).

Figure 4:
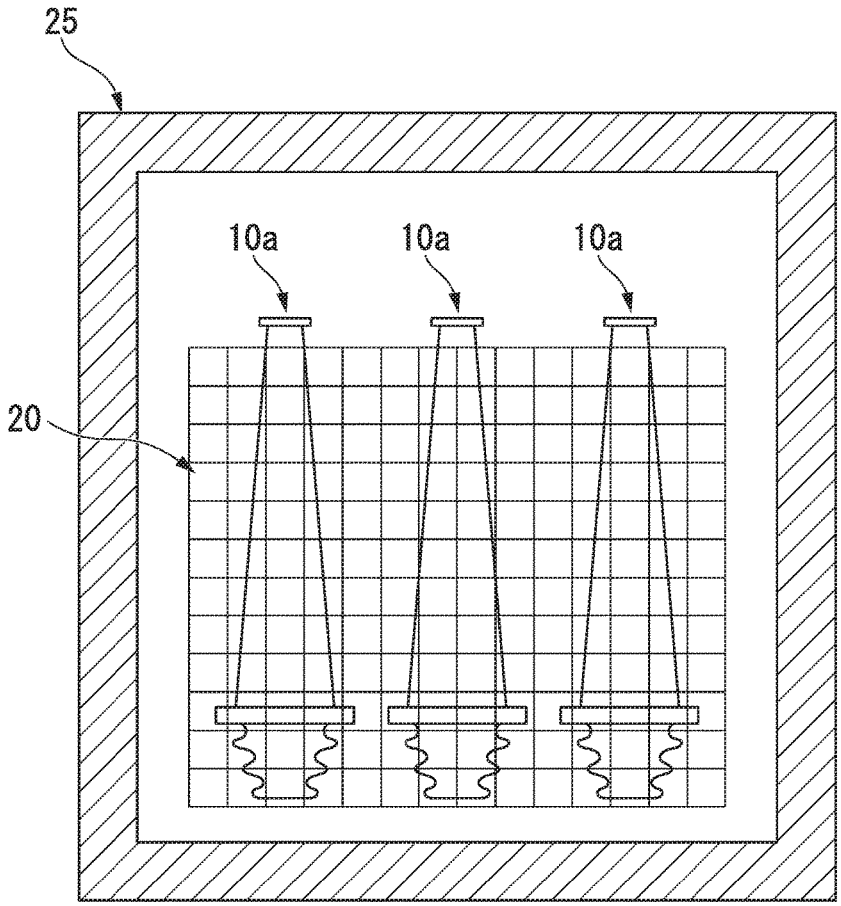
FIG. 4 is a view illustrating a heating step in the first embodiment of the present invention.

Subsequently, the stainless members, which have been subjected to the burr removing step (S2), are heated again (S3: heating step). As illustrated in FIG. 4, in the heating step (S3), stainless members 10*a*, which have been subjected to the burr removing step (S2), are placed into metal baskets 20, and the stainless member 10*a* in each basket 20 is placed into a heating furnace 25. Multiple openings are formed in the basket 20 such that air can be supplied into the inside of the basket 20 from the outside. In the heating step (S3), the stainless members 10*a* are solutionized by heating the stainless members 10*a* inside the heating furnace 25 to 1000° C. or greater, and maintaining the temperature for a predetermined length of time.

Figure 5:
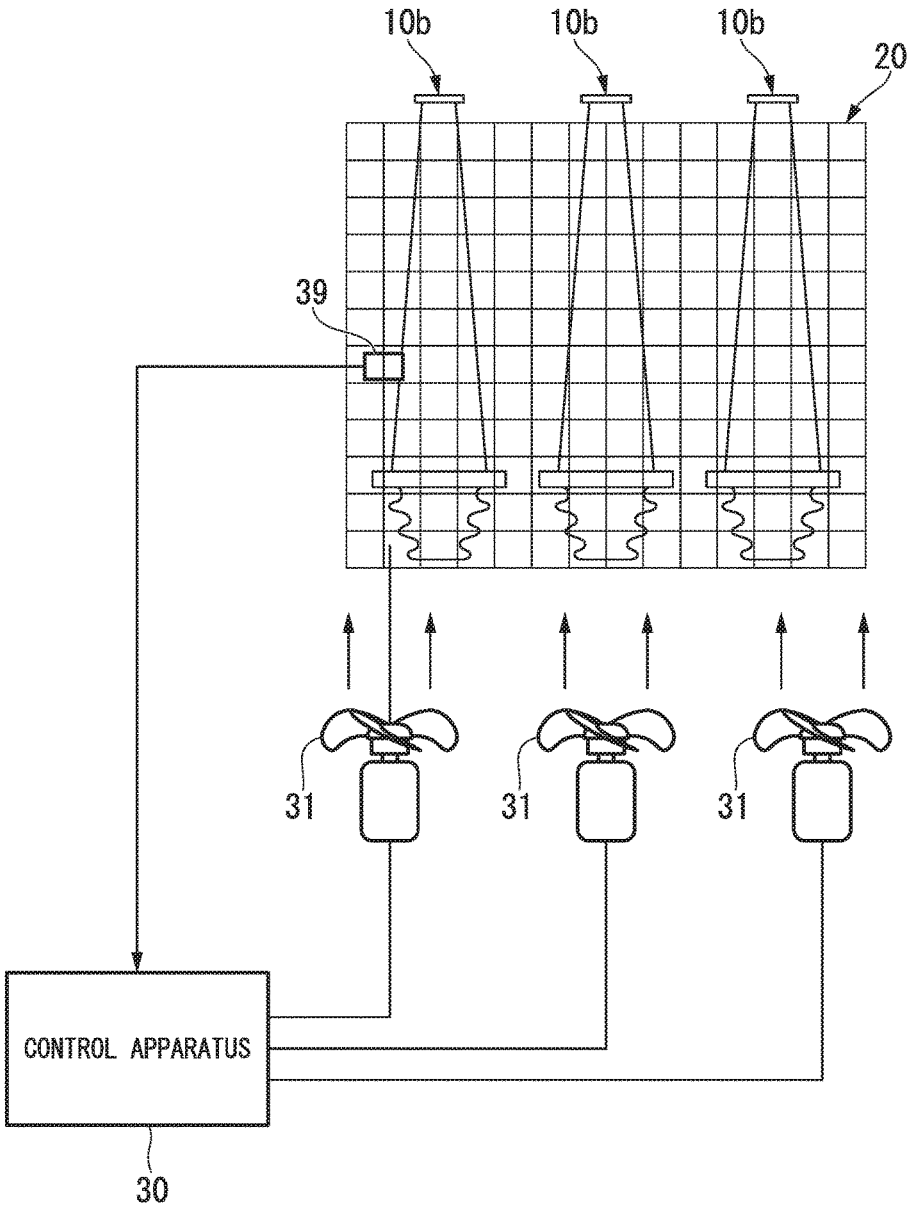
FIG. 5 is a view illustrating a cooling step in the first embodiment of the present invention.

When the heating step (S3) is ended, as illustrated in FIG. 5, a stainless member 10*b* in each basket 20, which has been subjected to the heating step (S3), is extracted from the heating furnace 25, and the stainless member 10*b* is forcibly cooled by blowing air, that is, a cooling medium to the stainless member 10*b* via a fan 31 (S4: cooling step). In the cooling step (S4), a control apparatus 30 controls the amount of driving the fan 31, that is, the flow rate of air blown to the stainless member 10*b*. The amount of driving the fan 31, and a time for changing the amount of driving the fan 31 (the length of time elapsed from when the driving of the fan 31 is started) are set in the control apparatus 30 in advance. The control apparatus 30 controls the driving of the fan 31 based on a set value.

Figure 6:
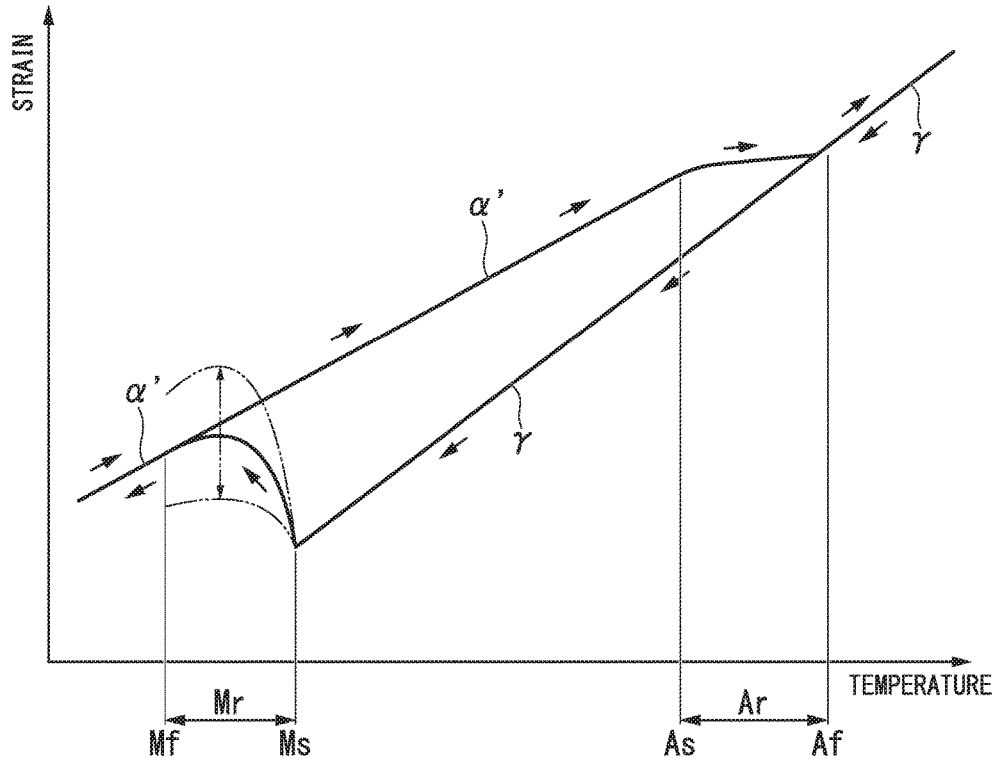
FIG. 6 is a graph illustrating a change in strain relative to a change in the temperature of a precipitation hardening stainless steel.

A relationship between the temperature and the strain of a precipitation hardening stainless steel, which is the material of the stainless member 10*b*, will be described with reference to FIG. 6.

The room-temperature structure of a precipitation hardening stainless steel is in a martensitic phase α'. The crystalline structure of the martensitic phase α' is a body-centered cubic lattice. When the precipitation hardening stainless steel is heated to approximately 600° C., gradual phase transformation of the structure from the martensitic phase α' to an austenitic phase γ starts. When the precipitation hardening stainless steel is further heated at a temperature which is several tens degrees C. higher than approximately 600° C., the phase transformation ends, and the entire structure is in the austenitic phase γ. The crystalline structure of the austenitic phase γ is a face-centered cubic lattice. A heating phase-transformation temperature range Ar refers to a temperature range from a heating phase-transformation start temperature As, which is a phase-transformation start temperature during heating, to a heating phase-transformation end temperature Af which is a phase-transformation end temperature during heating. Even if the precipitation hardening stainless steel is further heated to a temperature of 1000° C. or greater at which the aforementioned solutionizing treatment is performed, the structure is in the austenitic phase γ.

Until the temperature of the precipitation hardening stainless steel reaches the heating phase-transformation start temperature As from room temperature, the temperature and the thermal strain have a substantially proportional relationship, and the thermal strain increases along with the temperature increase. That is, the volume of the precipitation hardening stainless steel expands along with the temperature increase until the temperature reaches the heating phase-transformation start temperature As. In the heating phase-transformation temperature range Ar, there is no much increase in the thermal strain of the precipitation hardening stainless steel along with a temperature increase. That is, in the heating phase-transformation temperature range Ar, there is almost no increase in the volume of the precipitation hardening stainless steel along with the temperature increase. The volume of a body-centered cubic lattice, which is the crystalline structure of the martensitic phase α', is smaller than a face-centered cubic lattice which is the crystalline structure of the austenitic phase γ. For this reason, during phase transformation from the martensitic phase α' to the austenitic phase γ, even if the temperature is increased, there is almost no increase in the volume. In a temperature range higher than the heating phase-transformation temperature range Ar, the temperature and the thermal strain of the precipitation hardening stainless steel have a substantially proportional relationship, and the thermal strain increases along with a temperature increase.

When the precipitation hardening stainless steel is cooled to approximately 150° C. from a temperature of 1000° C. or greater at which the aforementioned solutionizing treatment is performed, gradual phase transformation of the structure from the austenitic phase γ to the martensitic phase α' starts. When the precipitation hardening stainless steel is further cooled to a temperature which is several tens degrees C. lower than an approximately 150° C., the phase transformation ends, and the entire structure in the martensitic phase α'. A cooling phase-transformation temperature range Mr refers to a temperature range from a cooling phase-transformation start temperature Ms, which is a phase-transformation start temperature during cooling, to a cooling phase-transformation end temperature Mf which is a phase-transformation end temperature during cooling.

Until the temperature of the precipitation hardening stainless steel reaches the cooling phase-transformation start temperature Ms from a temperature of 1000° C. or greater at which the aforementioned solutionizing treatment is performed, the temperature and the thermal strain have a substantially proportional relationship, and the thermal strain decreases along with the temperature decrease. In contrast, in the cooling phase-transformation temperature range Mr, the thermal strain of the precipitation hardening stainless steel increases along with a temperature decrease. In a temperature range lower than the cooling phase-transformation temperature range Mr, the temperature and the thermal strain of the precipitation hardening stainless steel have a substantially proportional relationship, and the thermal strain decreases along with a temperature decrease.

The precipitation hardening stainless steel has been described. Basically similar to the precipitation hardening stainless steel, during heating and cooling, phase transformation occurs in martensitic stainless steels, ferritic stainless steels, and austenitic-ferritic two-layer stainless steels. Basically, a relationship between the temperature and the thermal strain of these stainless steels is the same as that of the temperature and the thermal strain of the precipitation hardening stainless steel. In contrast, in a temperature range from room temperature to a temperature at which the solutionizing treatment is performed, phase transformation does not occur in an aluminum alloy member, which is a target for heat treatment and is disclosed in PTL 2 described in the background art section.

A portion, which is easily cooled (in other words, easily heated), and a portion, which is not easily cooled (in other words, not easily heated) may be formed in a metal member depending on the shape of the metal member. Specifically, a portion of the metal member, which is easily cooled, is a large surface area portion that has a large surface area per unit mass. A portion of the metal member, which is not easily cooled, is a small surface area portion that has a small surface area per unit mass. In the embodiment, as illustrated in FIG. 3, in the blade body 11, each of a blade front edge portion 14*a* including the blade front edge 14 and a blade rear edge portion 15*a* including the blade rear edge 15 has a blade thickness dimension smaller than that of a blade central portion between the blade front edge portion 14*a* and the blade rear edge portion 15*a*, and thus, each of the blade front edge portion 14*a* and the blade rear edge portion 15*a* forms a large surface area portion A that has a large surface area per unit mass, and forms portions which are easily cooled. In contrast, the blade central portion between the blade front edge portion 14*a* and the blade rear edge portion 15*a* forms a small surface area portion B having a small surface area per unit mass, and foams a portion which is not easily cooled. In a case where such a metal member is heated or cooled, a high-temperature portion and a low-temperature portion may be formed in the metal member. As a result, in a process of heating or cooling the metal member, thermal stress and strain occur in the metal member.

In a case where the metal member is heated inside the heating furnace 25, the temperature of the metal member is increased along with an increase in the internal temperature of the heating furnace 25 in which the metal member is disposed, that is, an increase in an ambient temperature. In contrast, in a case where the metal member is taken out of the heating furnace 25, and is cooled, an ambient temperature is room temperature relative to the temperature of the metal member, and a temperature difference between the temperature of the metal and the ambient temperature is large. As a result, basically, a temperature decrease rate during cooling is higher than a temperature increase rate during heating. For this reason, a temperature difference between the high-temperature portion and the low-temperature portion of the metal member becomes small during heating. In contrast, a temperature difference between the high-temperature portion and the low-temperature portion of the metal member becomes large during cooling. Accordingly, suppression of the temperature difference between the high-temperature portion and the low-temperature portion of the metal member during cooling leads to suppression of the occurrence of thermal stress, and suppression of strain.

As described above, in the cooling step (S4) of the embodiment, the flow rate of air blown to the stainless member 10*b* is controlled.

In the cooling step (S4) of the embodiment, control of the flow rate of the cooling medium will be described with reference to FIG. 7.

Figure 7:
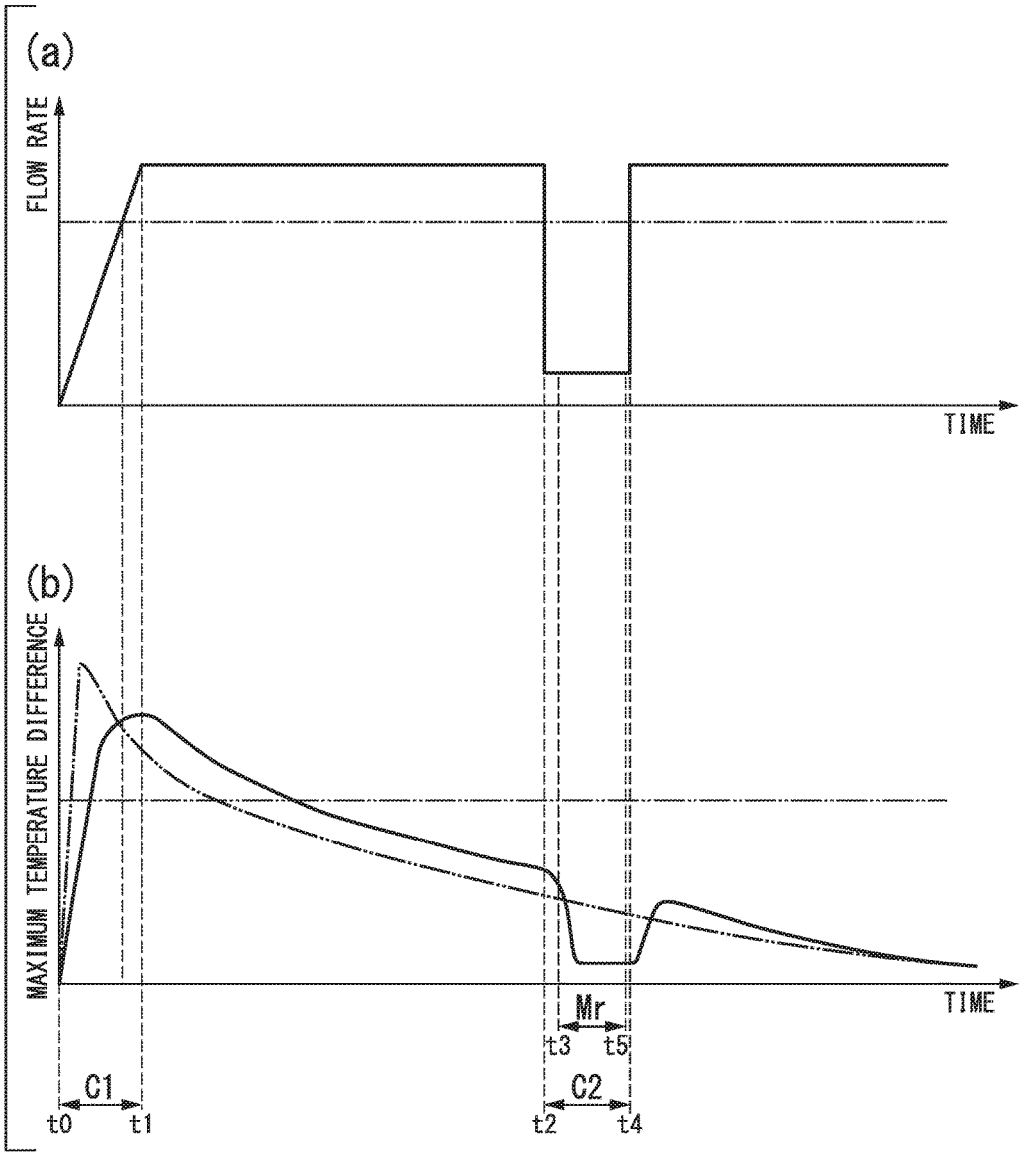
FIG. 7 represents a change in the flow rate of a cooling medium and the maximum temperature difference of a stainless member relative to an elapse of time in the first embodiment of the present invention, FIG. 7(*a*) is a graph illustrating a change in the flow rate of the cooling medium relative to an elapse of time, and FIG. 7(*b*) is a graph illustrating a change in the maximum temperature difference of the stainless member relative to an elapse of time.

When the cooling step (S4) is started, as illustrated in FIG. 7(*a*), the control apparatus 30 drives the fan 31 such that the amount of driving the fan 31 is gradually increased from a time (t0) when the driving of the fan 31 is started until when a first predetermined time (t1) has elapsed. In the embodiment, a first control temperature range C1 refers to a temperature range set from the time (t0) when the driving of the fan 31 is started until when the first predetermined time has elapsed (t1). In the first control temperature range C1, the flow rate of the cooling medium (air) blown to the stainless member 10*b* per unit time is gradually increased.

When the first predetermined time (t1) has elapsed from the time (t0) when the driving of the fan 31 is started, the control apparatus 30 sets the amount of driving the fan 31 to be constant. That is, the control apparatus 30 sets the flow rate of air blown to the stainless member 10*b* per unit time to be constant. A time when the flow rate of air per unit time is set be constant, in other words, a time for the end of the first control temperature range C1 is set to occur before the temperature of the stainless member 10*b* reaches the cooling phase-transformation start temperature Ms.

When a second predetermined time (t2) has elapsed from the time (t0) when the driving of the fan 31 is started, the control apparatus 30 rapidly decreases the amount of driving the fan 31, and maintains the decreased amount of driving. That is, when the second predetermined time (t2) has elapsed from the time (t0) when the driving of the fan 31 is started, the control apparatus 30 rapidly decreases the flow rate of air blown to the stainless member 10*b* per unit time, and maintains the decreased flow rate of air. A time (t2) when the flow rate of air per unit time is rapidly decreased is set to occur immediately before a time (t3) when the temperature of the stainless member 10*b* reaches the cooling phase-transformation start temperature Ms.

When a third predetermined time (t5) has elapsed from the time (t2) when the amount of driving the fan 31 is rapidly decreased, the control apparatus 30 rapidly increases the amount of driving the fan 31 to the amount of driving which has been set before the time (t2) when the amount of driving the fan 31 is rapidly decreased. That is, when the third predetermined time (t5) has elapsed from the time (t2) when the flow rate of air per unit time is rapidly decreased, the control apparatus 30 rapidly increases the flow rate of air per unit time to the flow rate of air which has been set before the time (t2) when the flow rate of air is rapidly decreased. The time (t5) when the flow rate of air per unit time is rapidly increased is set to occur immediately after a time (t4) when the temperature of the stainless member 10*b* reaches the cooling phase-transformation end temperature Ms.

In the embodiment, a second control temperature range C2 refers to a temperature range including the cooling phase-transformation temperature range Mr, that is, a temperature range from a temperature slightly higher than the cooling phase-transformation start temperature Ms to a temperature slightly lower than the cooling phase-transformation end temperature Mf. In the embodiment, the flow rate of air in the second control temperature range C2 is lower than those immediately before the temperature of the stainless member 10*b* reaches the second control temperature range C2 and immediately after the temperature passes the second control temperature range C2.

When the amount of driving the fan 31 is rapidly increased (t5), thereafter, the control apparatus 30 maintains the increased amount of driving the fan 31. That is, when the air flow rate of air per unit time is rapidly increased (t5), thereafter, the control apparatus 30 maintains the increased flow rate of air per unit time.

When the stainless member 10*b* is taken out of the heating furnace 25, and the fan 31 starts blowing air to the stainless member 10*b*, an ambient temperature around the stainless member 10*b* is rapidly decreased. As illustrated by the two-dot chain line in FIG. 7(*a*), in a case where the flow rate of air per unit time is constant and high from the start of the cooling step (S4), the temperature of the stainless member 10*b* is rapidly decreased.

When the temperature of the stainless member 10*b* is rapidly decreased, a temperature difference between the large surface area portion A and the small surface area portion B of the stainless member 10*b* is increased, and large strain occurs. In the embodiment, the amount of driving the fan 31 is gradually increased in the first control temperature range C1 set from start time t0 of the cooling step (S4) until when the first time (t1) has elapsed. For this reason, in the embodiment, as illustrated by the two-dot chain line in FIG. 7(*b*), the maximum temperature difference of the stainless member 10*b* in the first control temperature range C1, which is an initial cooling time zone, is decreased compared to a case where the flow rate of air per unit time is constant and high from the start of the cooling step (S4). Accordingly, in the embodiment, it is possible to suppress the occurrence of strain in the initial cooling time zone.

Larger strain occurs in the stainless member 10*b* due to small stress in a phase transformation state than in a non-phase transformation state. For this reason, the occurrence of thermal stress during phase transformation is preferably suppressed by decreasing a temperature difference between the large surface area portion A and the small surface area portion B of the stainless member 10*b* in a phase transformation state to a level smaller than a temperature difference between the large surface area portion A and the small surface area portion B of the stainless member 10*b* in a non-phase transformation state.

In the embodiment, as described with reference to FIG. 7(*a*), the flow rate of air in the second control temperature range C2 is lower than those immediately before the temperature of the stainless member 10*b* reaches the second control temperature range C2 including the cooling phase-transformation temperature range Mr, and immediately after the temperature passes the second control temperature range C2. For this reason, in the embodiment, as illustrated in FIG. 7(*b*), the maximum temperature difference in the second control temperature range C2 including the cooling phase-transformation temperature range Mr is further decreased than those immediately before the temperature of the stainless member 10*b* reaches the second control temperature range C2 and immediately after the temperature passes the second control temperature range C2, and thus, it is possible to suppress the occurrence of thermal stress during phase transformation. Accordingly, in the embodiment, it is possible to suppress the occurrence of strain during phase transformation.

When the cooling step (S4) is ended, and the temperature of the stainless member 10*b* becomes room temperature, the stainless member 10*b* is subjected to a finishing process (S5: finishing step). In the finishing step (S5), the stainless member 10*b* is machine-processed, for example, the stainless member 10*b* is grinded or polished such that the dimension of each portion of the stainless member 10*b* is within an allowable dimension. As necessary, the machine-processed stainless member 10*b* is subjected to a surface treatment.

As such, the rotor blade is produced as a forged product.

In the embodiment, in the cooling step (S4), the initial cooling time zone and strain during phase transformation are decreased by controlling the initial cooling time zone in which the temperature of the stainless member 10*b* is rapidly changed, and the flow rate of air during phase transformation in which deformation is likely to occur. Accordingly, in the embodiment, it is possible to decrease strain and residual stress of the stainless member 10*b* after the cooling step (S4) is complete.

In the embodiment, after the cooling step (S4) is complete, the finishing step (S5), for example, machine processing is executed on the stainless member 10*b*. When residual stress is present in the stainless member 10*b* before the machine processing is executed, the residual stress is released in the machine processing, and strain occurs due to the release of the residual stress. In the embodiment, as described above, since it is possible to decrease the residual stress of the stainless member 10*b* after the cooling step (S4) is complete, even if the residual stress is released in machining process, it is possible to decrease strain caused by the release of the residual stress.

When the predetermined length of time has elapsed from when the driving of the fan 31 is started, the control apparatus 30 of the embodiment changes the amount of driving the fan 31 by controlling the time for changing the amount of driving the fan 31. In contrast, in the embodiment, as illustrated in FIG. 5, a temperature sensor 39 may be provided to detect the temperature of the stainless member 10*b* during the cooling step (S4), and in a case where the temperature of the stainless member 10*b* detected by the temperature sensor 39 reaches a predetermined temperature, the control apparatus 30 may change the amount of driving the fan 31 by controlling the time for changing the amount of driving the fan 31. Examples of the predetermined temperature of the stainless member 10*b* include a control end temperature of the first control temperature range C1, and a control start temperature and a control end temperature of the second control temperature range C2. The control start temperature of the second control temperature range C2 is the temperature of the stainless member 10*b* which is slightly higher than the cooling phase-transformation start temperature Ms. The control end temperature of the second control temperature range C2 is the temperature of the stainless member 10*b* which is slightly lower than the cooling phase-transformation end temperature Mf. An infrared contactless thermometer, a thermocouple, or the like is used as the temperature sensor 39 detecting the temperature.

Second Embodiment

Figure 8:
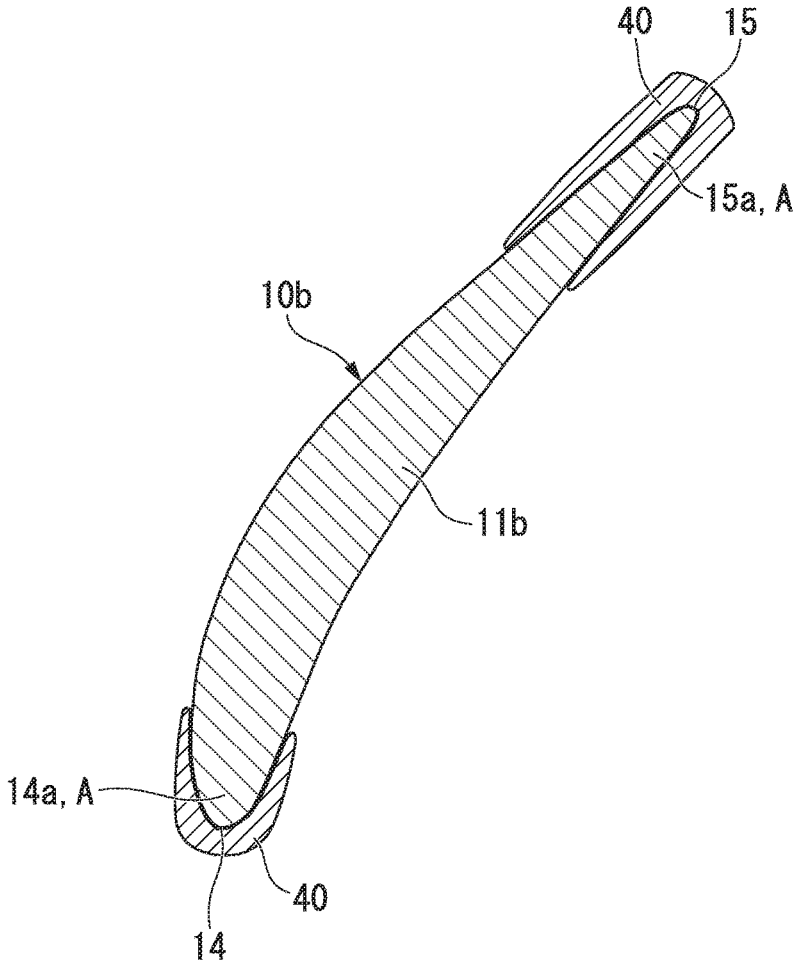
FIG. 8 is a sectional view of a rotor blade (stainless member) and a covering member in a second embodiment of the present invention.

Hereinafter, a second embodiment of the present invention will be described with reference to FIGS. 8 to 10.

Similar to the first embodiment, also, in the second embodiment, a rotor blade of a steam turbine is produced. Similar to the first embodiment, also, in the second embodiment, the rotor blade of the steam turbine is produced by executing the forging step (S1), the burr removing step (S2), the heating step (S4), the cooling step (S4), and the finishing step (S5). In the embodiment, cooling technique of the stainless member 10*b* in the cooling step (S4) is different from that in the first embodiment.

In the cooling step (S4) of the embodiment, cooling of the large surface area portion A of the stainless member 10*b*, that is, a cooling target is suppressed by covering the large surface area portion A with a covering member 40. Specifically, in the embodiment, as illustrated in FIG. 8, in the blade body 11*b* of the blade the forged stainless member 10*b* which is an intermediate product of the rotor blade, each of the blade front edge portion 14*a* including the blade front edge 14 and the blade rear edge portion 15*a* including the blade rear edge 15 forms the large surface area portion A having a large surface area per unit mass. In the embodiment, as described above, the large surface area portions A are covered with the covering members 40. In the embodiment, as illustrated in FIG. 9, the covering member 40 covers only an intermediate portion of the blade front edge portion 14*a* of the blade body 11, which is located at an intermediate position in the blade length direction Da. Similarly, the covering member 40 covers only an intermediate portion of the blade rear edge portion 15*a* of the blade body 11, which is located at an intermediate position in the blade length direction Da. The reason for this is that thermal strains of the blade front edge portion 14*a* and the blade rear edge portion 15*a* on a base portion 13 side of the blade body 11 is lower than those of the blade front edge portion 14*a* and the blade rear edge portion 15*a* in a region from the intermediate portion in the blade length direction Da to the tip portion 12. Another reason for this is that the strain of the intermediate portion of the blade body 11 is reflected as a displacement of the tip portion 12, and the strain of the tip portion 12 is not reflected in the intermediate portion, but can be easily corrected.

The covering member 40 takes the role of decreasing a temperature difference between the small surface area portion B and the large surface area portion A by approximating the amount of heat dissipation from the small surface area portion B not covered with the covering member 40 to the amount of heat dissipation from the large surface area portion A covered with the covering member 40. For this reason, insofar as the covering member 40 is capable of taking the aforementioned role, the covering member 40 may be made of any material. The covering member 40 may be made of an insulating material, steel, an aluminum alloy, a stainless steel, or the like.

Figure 9:
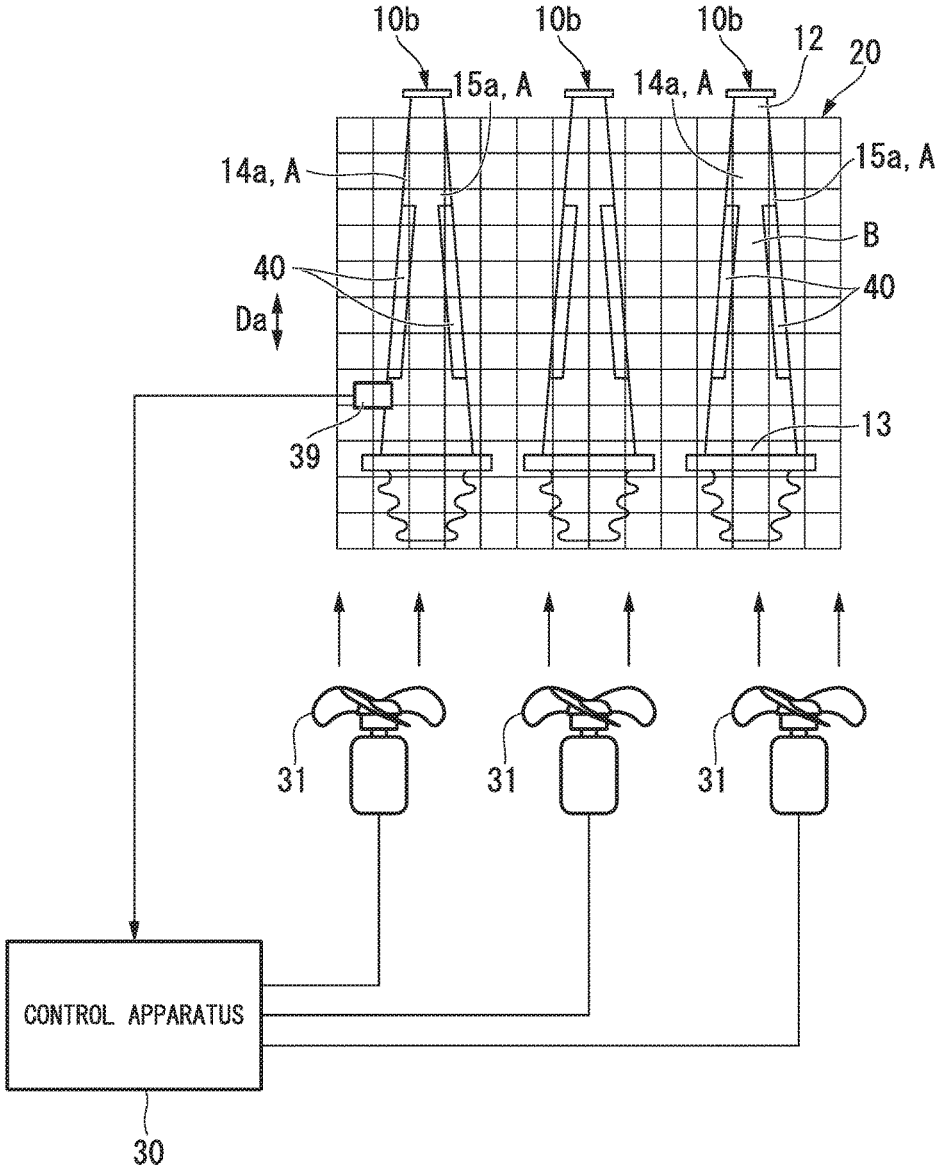
FIG. 9 is a view illustrating a cooling step in the second embodiment of the present invention.
Figure 10:
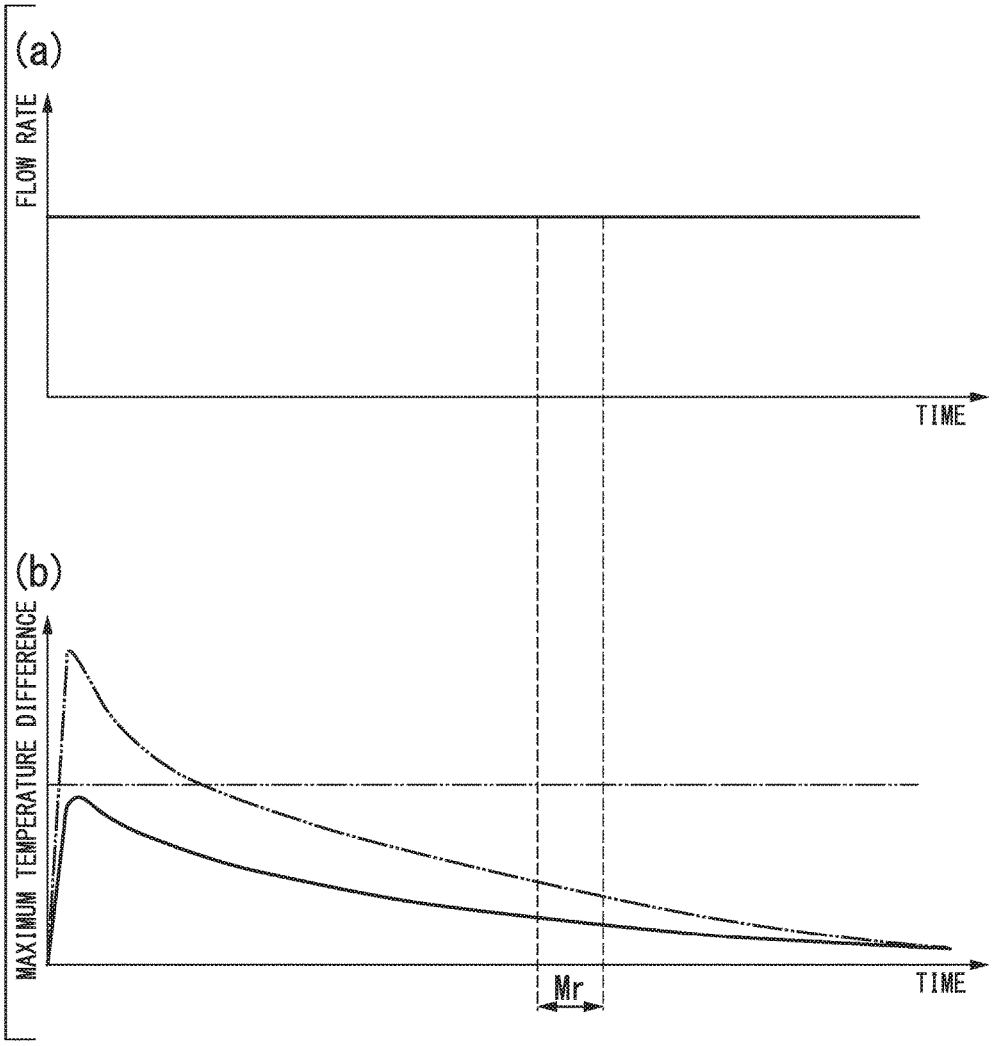
FIG. 10 represents a change in the flow rate of a cooling medium and the maximum temperature difference of a stainless member relative to an elapse of time in the second embodiment of the present invention, FIG. 10(*a*) is a graph illustrating a change in the flow rate of a cooling medium relative to an elapse of time, and FIG. 10(*b*) is a graph illustrating a change in the maximum temperature difference of the stainless member relative to an elapse of time.

Also, in the cooling step (S4) of the embodiment, as illustrated in FIG. 9, the stainless member 10*b* is forcibly cooled by driving the fan 31. In the embodiment, as illustrated in FIG. 10(*a*), the flow rate of air blown to the stainless member 10*b* per unit time is constant from the start to the end of the cooling step (S4).

In contrast, in the embodiment, since the large surface area portion A of the stainless member 10*b*, which is easily cooled, is covered with the covering member 40, the amount of heat dissipation from the large surface area portion A approximates to the amount of heat dissipation from the small surface area portion B. For this reason, in the embodiment, as illustrated in FIG. 10(*b*), it is possible to decrease the maximum temperature difference (illustrated by the solid line) of the stainless member 10*b* to a level which is lower than the maximum temperature difference (illustrated by the two-dot chain line) of the stainless member 10*b* in a case where the large surface area portion A is not covered with the covering member 40, and the flow rate of air blown to the stainless member 10*b* per unit time is constant.

Accordingly, similar to the first embodiment, also, in the cooling step (S4) of the embodiment, it is possible to decrease the initial cooling time zone in which the temperature of the stainless member 10*b* is rapidly changed, and strain in the temperature range including the cooling phase-transformation temperature range Mr in which deformation is likely to occur. For this reason, also, in the embodiment, it is possible to decrease strain and residual stress of the stainless member 10*b* after the cooling step (S4) is complete.

The covering member 40 may be attached to a stainless member before the heating step (S4) is started. In this case, when the cooling step (S4) is started, it is possible to substantially eliminate a temperature difference between the stainless member 10*b* and the covering member 40, and to suppress the occurrence of thermal strain based on the temperature difference when the covering member 40 is attached to the stainless member 10*b*. The covering member 40 may be made of the same material as that of the stainless member 10*b* which is a cooling target. In this case, since the thermal expansion coefficient of the cooling target is the same as that of the covering member 40, the cooling target and the covering member 40 are capable of integrally contracting in a cooling process, and heat transfer between the cooling target and the covering member 40 can be substantially constant. In addition, the cooling target and the covering member 40 have the same thermal properties such as a heat transfer coefficient other than a thermal expansion coefficient. For this reason, in this case, it is possible to easily determine various dimensions of the covering member 40, by which the amount of heat dissipation from the small surface area portion B not covered with the covering member 40 is adjusted to be substantially the same as the amount of heat dissipation from the large surface area portion A covered with the covering member 40.

The flow rate of air blown to the stainless member 10*b* per unit time is adjusted to be constant from the start to the end of the cooling step (S4). In contrast, similar to the first embodiment, also, in the embodiment, the initial cooling time zone, in which the temperature of the stainless member 10*b* is rapidly changed, may be controlled. The flow rate of air may be controlled during phase transformation in which deformation is likely to occur.

Modification Example

In the embodiments, the heating step (S3) and the cooling step (S4) are executed after the forging step (S1) is executed. In contrast, a rolling step may be executed instead of the forging step (S1), and the same aforementioned cooling step may be executed after the rolling step and the heating step are executed. The heating step and the cooling step may be executed without executing the forging step or the rolling step.

In the embodiments, the rotor blade 10 of a steam turbine is a production target. In contrast, insofar as a stainless member is subjected to the heating step and the cooling step, any object may be used as a target.

In the example illustrated in the embodiments, a stainless member is made of a precipitation hardening stainless steel. In contrast, as described above, basically similar to the precipitation hardening stainless steel, during heating and cooling, phase transformation occurs in martensitic stainless steels, ferritic stainless steels, and austenitic-ferritic two-layer stainless steels. As a result, also, in a case where a stainless member is made of any of the aforementioned materials, the same cooling step as in the embodiments may be executed.

INDUSTRIAL APPLICABILITY

According to an aspect of the present invention, it is possible to decrease strain of a stainless member.

REFERENCE SIGNS LIST

10: ROTOR BLADE
10A, 10B: STAINLESS MEMBER
11, 11B: BLADE BODY
14: BLADE FRONT EDGE
15: BLADE REAR EDGE
31: FAN
30: CONTROL APPARATUS
40: COVERING MEMBER
A: LARGE SURFACE AREA PORTION
B: SMALL SURFACE AREA PORTION

The invention claimed is:

1. A method for heat treatment of a stainless member, a heating step, in which a stainless member is heated to a temperature within or above a heating phase-transformation temperature range in which the stainless member is phase-transformed when the stainless member is heated, is executed; and a cooling step, in which the stainless member heated in the heating step is cooled to a temperature below a cooling phase-transformation temperature range in which the stainless member is phase-transformed when the stainless member is cooled, is executed, wherein in the cooling step, a cooling medium is supplied to the stainless member, a flow rate of the cooling medium supplied to the stainless member per unit time is gradually increased from when the cooling step is started until when a predetermined length of time has elapsed, or from when the cooling step is started until when the temperature of the stainless member reaches a predetermined temperature, and a flow rate of the cooling medium in a control temperature range including the cooling phase-transformation temperature range is set to be smaller than those immediately before the temperature of the stainless member reaches the control temperature range and immediately after the temperature passes the control temperature range, wherein the predetermined length of time is shorter than a length of time from when the cooling step is started until when a temperature of the stainless member is a temperature within the heating phase-transformation temperature range, wherein the predetermined temperature is above the heating phase-transformation temperature range.

2. The method for heat treatment of a stainless member according to claim 1, wherein in the cooling step, a length of time from when the cooling of the stainless member is started until when the temperature of the stainless member reaches the cooling phase-transformation temperature range is obtained in advance, and wherein in the cooling step, the flow rate of the cooling medium supplied to the stainless member is decreased before the length of time obtained in advance has elapsed from when the cooling of the stainless member is started.

3. The method for heat treatment of a stainless member according to claim 1, wherein a phase-transformation start temperature of the cooling phase-transformation temperature range is obtained in advance, and wherein in the cooling step, the flow rate of the cooling medium supplied to the stainless member is decreased before the temperature of the stainless member reaches the phase-transformation start temperature.

4. The method for heat treatment of a stainless member according to claim 1, wherein the stainless steel member has a small surface area portion having a surface area per unit mass equal to or less than a first surface area and a large surface area portion having a surface area per unit mass larger than the first surface area, and wherein in the cooling step, a covering member covering the large surface area portion of the stainless member is provided on a large surface area portion having a large surface area per unit mass.

5. The method for heat treatment of a stainless member according to claim 4, wherein dimensions of the covering member are determined such that an amount of heat dissipation per unit mass from the large surface area portion covered with the covering member is the same as the amount of heat dissipation per unit mass from a portion not covered with the covering member.

6. The method for heat treatment of a stainless member according to claim 4, wherein the covering member is made of the same material as that of the stainless member.

7. The method for heat treatment of a stainless member according to claim 4, wherein the covering member is provided on the stainless member before the heating step is started.

8. The method for heat treatment of a stainless member according to claim 1, wherein the stainless member is made of a precipitation hardening stainless steel.

* * * * *